US008001881B2

(12) United States Patent
Sy

(10) Patent No.: US 8,001,881 B2
(45) Date of Patent: Aug. 23, 2011

(54) FIRING RATE REDUCTION SYSTEM FOR AN AUTOMATIC FIREARM

(76) Inventor: Ferdinand S. Sy, San Dimas, CA (US)

( * ) Notice: Subject to any disclaimer, the term of this patent is extended or adjusted under 35 U.S.C. 154(b) by 0 days.

(21) Appl. No.: 11/308,008

(22) Filed: Mar. 2, 2006

(65) Prior Publication Data

US 2011/0174148 A1 Jul. 21, 2011

Related U.S. Application Data

(60) Provisional application No. 60/593,992, filed on Mar. 2, 2005.

(51) Int. Cl.
*F41A 19/64* (2006.01)

(52) U.S. Cl. ..... 89/131

(58) Field of Classification Search ..... 89/129.01, 89/129.02, 130, 131, 132, 149, 150
See application file for complete search history.

(56) References Cited

U.S. PATENT DOCUMENTS

| | | | | | |
|---|---|---|---|---|---|
| 2,167,672 | A | * | 8/1939 | Nomar | 89/132 |
| 2,389,095 | A | * | 11/1945 | Vesely | 89/129.01 |
| 2,495,460 | A | * | 1/1950 | Koucky | 89/130 |
| 2,971,441 | A | * | 2/1961 | Reed | 89/130 |
| 3,301,133 | A | * | 1/1967 | Sturtevant | 89/131 |
| 3,802,313 | A | * | 4/1974 | Rocha | 89/130 |
| 4,028,993 | A | * | 6/1977 | Reynolds | 89/130 |
| 4,066,000 | A | * | 1/1978 | Rostocil | 89/198 |
| 4,889,032 | A | * | 12/1989 | Major | 89/129.01 |
| 5,038,666 | A | * | 8/1991 | Major | 89/197 |

* cited by examiner

*Primary Examiner* — Bret Hayes
(74) *Attorney, Agent, or Firm* — Geoffrey E. Dobbin

(57) ABSTRACT

A firing rate reduction system utilizing a slideable, independent sear disconnector includes a bolt carrier having a straight channel terminating at the rear end of the bolt carrier, for disconnector movement within the bolt carrier. Detents are provided to arrest movement at forward and rearward positions. The force of inertia moves the independent disconnector into these extreme positions and creates a delay in firing time as additional time is required for the independent disconnector to reach final position.

5 Claims, 3 Drawing Sheets

FIRING RATE REDUCTION SYSTEM FOR AN AUTOMATIC FIREARM

CROSS-REFERENCES TO RELATED APPLICATIONS

The present Application is a non-provisional perfection of prior Provisional Application No. 60/593,992, filed Mar. 2, 2005.

FIELD OF THE INVENTION

The present invention relates to the filed of firearms and more particularly relates to the field of firing rate reduction systems for automatic firearms.

BACKGROUND OF THE INVENTION

One of the difficulties with automatic firearms is a tendency of firing rate to be too rapid for the user or for the mechanical limits of the weapon. Firing numerous rounds of ammunition from a rifle in full automatic firing mode tends to over heat the rifle and reduce accuracy by affecting the control of the user and the mechanics of the rifle itself. As a result, there is a greater risk of stray bullets, causing an increased risk of serious physical injury and property damage and even an increased risk of mechanical malfunction. However, the benefits of an automatic firing mode, i.e. not having to pull a trigger every time a user wishes to fire the next round, is seen as beneficial in those life and death situations where use of a firearm is deemed necessary. Therefore, what is needed is a manner of maintaining the automatic firing mode, while slowing the rate of fire, allowing more control for the user and allowing more time for the rifle to recover after firing a round, thus limiting mechanical malfunction and over heating.

Rate reduction systems are known in the prior art. They range from counter balance, hydraulic, and pneumatic systems, altering buffering capabilities of the rifle, and complicated electronic firing systems. Some have even reduced round length and charge load in a cartridge to reduce recoil force and create a slower rate of fire. However, all of these prior art systems require significant modification to a rifle, some are effective with only certain kinds and shapes of ammunition, the electronic system requires additional wiring, controls and batteries, all of which can fail and in most cases require significant cost to manufacture and install. Likewise, with all of these prior art systems, training is required for a user to become familiar with the weapon's new characteristics.

The inventors of this invention have previously invented an independently slidable sear disconnector. The prior invention is pending for a patent in the Philippines. The invention modified the standard bolt carrier to remove the sear disconnector and placed the disconnector in a slidable block within the bolt carrier. The force of inertia on the block created a lag time between the bolt carrier and the sear disconnector, reducing the rate of fire with no compromise of other firing characteristics, eliminating the need for extensive re-training, reduced modification to the weapon, i.e. only replacing the bolt carrier system in a standard rifle, and a lower cost of manufacture. However, the system did require time for complicated assembly of numerous parts for installation.

The present invention is an improvement on the inventors' prior invention, reducing and simplifying parts for easier installation and even further lessening cost of manufacture. By simplifying installation and reducing number of parts, installation time is reduced and the invention features all of the benefits of the preceding invention including reduced re-training time and modification cost to the weapons.

SUMMARY OF THE INVENTION

In view of the foregoing disadvantages inherent in the known types of rate reduction systems this invention provides an improved firing rate reducer. As such, the present invention's general purpose is to provide a new and improved rate reducer that will be effective, easily manufactured and easily installed with no alteration of the weapon or its systems.

In practice, the rate reducer according to the present invention utilizes a slidable sear disconnector that is independent of the bolt carrier. The independence of the disconnector causes it to lag behind the bolt carrier as the rifle completes its firing cycle. The lag increases cyclic time and thereby reduces the rate of fire. The present invention also features a modified bolt carrier that is more conducive to assembly with the rate reduction system and a simplified sear disconnector.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE BEST MODE

With reference now to the drawings, the preferred embodiment of the firing rate reduction system is herein described. It should be noted that the articles "a", "an" and "the", as used in this specification, include plural referents unless the content clearly dictates otherwise.

Figure 1:
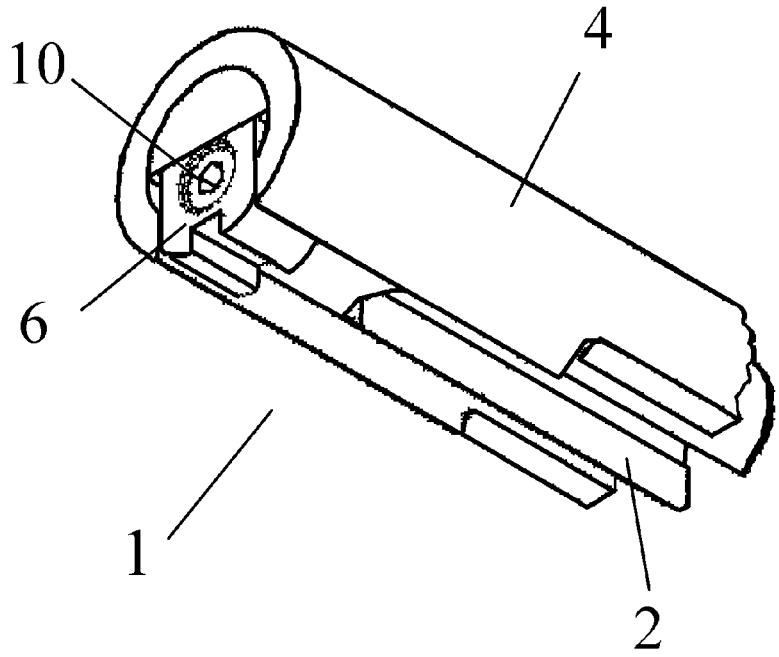
FIG. 1 is an isometric view of the system assembled.
Figure 2:
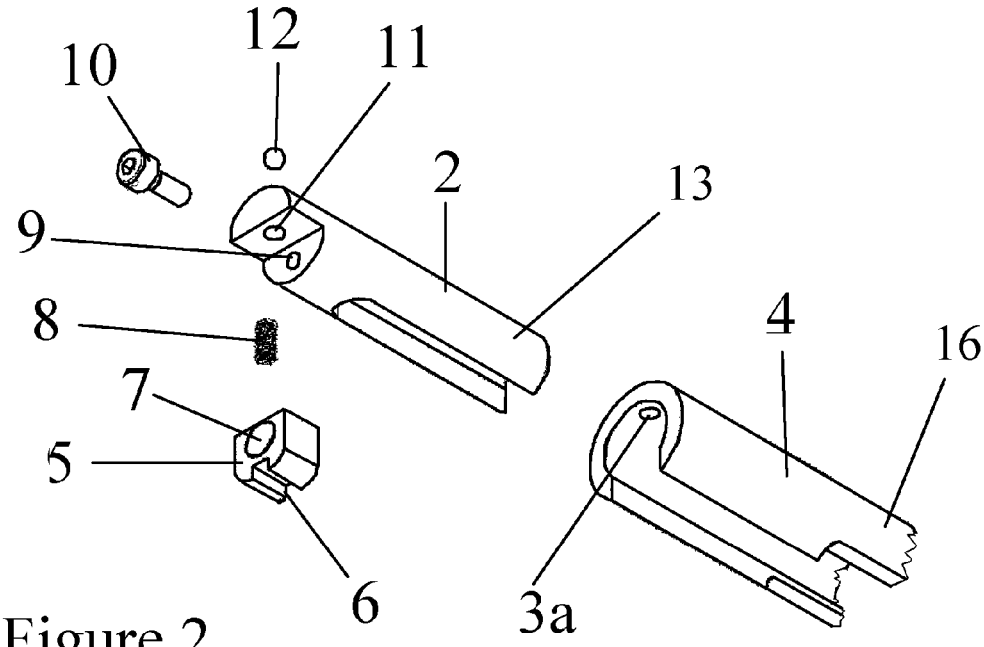
FIG. 2 is an exploded view of the system.
Figure 3A:
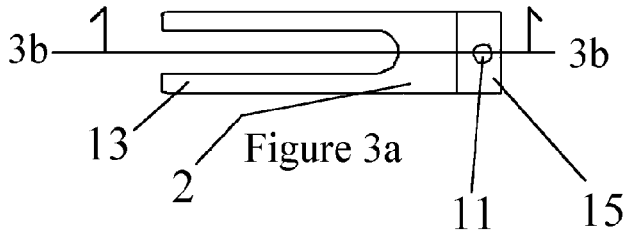
FIG. 3*a* is a top plan view of the disconnector base.
Figure 3C:
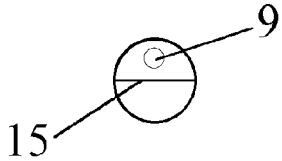
FIG. 3*c* is a rear plan view of the disconnector base of FIG. 3*a*.
Figure 3B:
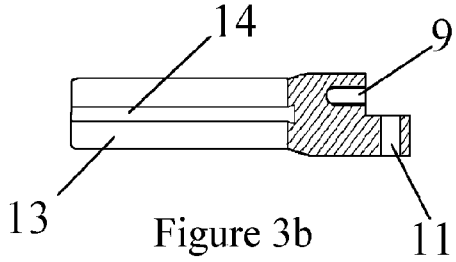
FIG. 3*b* is a sectional view of the disconnector base of FIG. 3*a* taken along line 3*b*.
Figure 5A:
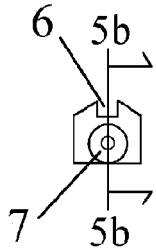
FIG. 5*a* is a rear plan view of the sear striker.
Figure 4A:
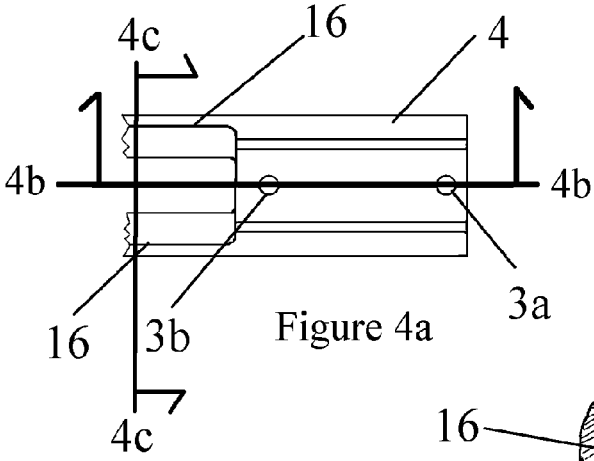
FIG. 4*a* is a top plan view of the bolt carrier.
Figure 5B:
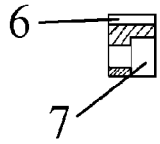
FIG. 5*b* is a sectional view of the sear striker of FIG. 5*a* taken along line 5*b*.
Figure 4C:
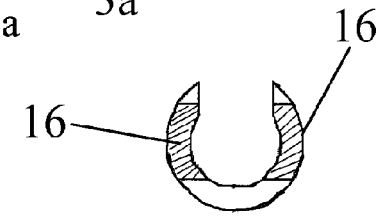
FIG. 4*c* is a sectional view of the bolt carrier of FIG. 4*a* taken along line 4*c*.
Figure 4B:
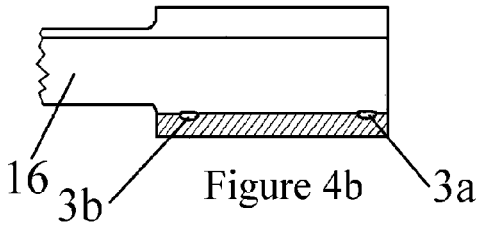
FIG. 4*b* is a sectional view of the bolt carrier of FIG. 4*a* taken along line 4*b*.
Figure 5C:
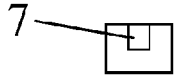
FIG. 5*c* is a bottom plan view of the sear striker of FIG. 5*a*.

Referring to FIG. 1, the system 1 comprises a modified, generally tubular bolt carrier 4, the rear of which is shown, with a sideable disconnector body 2 coaxially positioned within. On one end of disconnector body is sear striker 5 fastened with bolt 10. Additional parts are disclosed in FIGS. 2, 3*a*-3*c*, 4*a*-4*c*, and 5*a*-5*c*. As can be seen in FIG. 2, carrier body 4 contains 2 detents 3*a* and 3*b*, which interface with ball bearing 12 on disconnector body 2. Ball bearing 12 is inserted in channel 11 of disconnector body 2 and biased by spring 8 within channel 11. Sear striker 5 contains spring 8 in channel 11 when it is connected to body 2 by bolt 10 inserted through bores 7, in the sear striker 5, and 9, in the disconnector body 2. When disconnector body 2 is inserted within bolt carrier 4, sear striker 5 rests within channel 17 of carrier 4, allowing for sliding movement of disconnector body and arresting torsional movement of body 2 relative to carrier 4. Spring actuated ball bearing 12 in then free to interface with detents 3*a* and 3*b* as the body 2 moves within the carrier 4, stopping motion relative to carrier in a forward position with detent 3*b* and a rearward position with detent 3*a*.

Both rear bolt carrier 4 and disconnector body 2 are characterized by each having two diametrically opposed prongs on a forward side of each part. Disconnector body prongs 13 define a cylindrical channel 14 within prongs 13. Carrier prongs 16 likewise define a longer arcuate space along the side with carrier channel 17 than the side diametrically opposed to carrier channel 17. These prongs connect with the remainder of the carrier body, which is not shown as it is well known in the art. The purposes of said channels being seen below.

Figure 6:
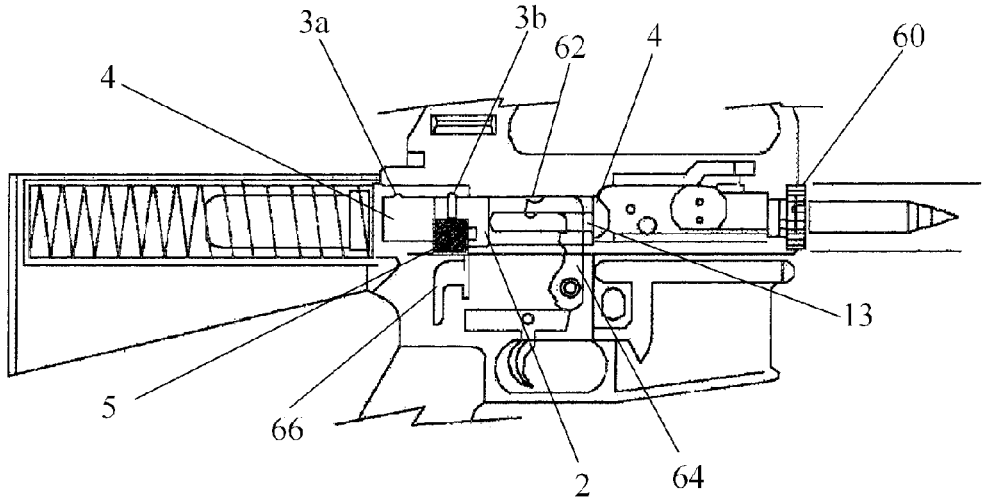
FIG. 6 is a partial sectional view of an AR-15 type rifle, with the invention installed, ready to fire.
Figure 7:
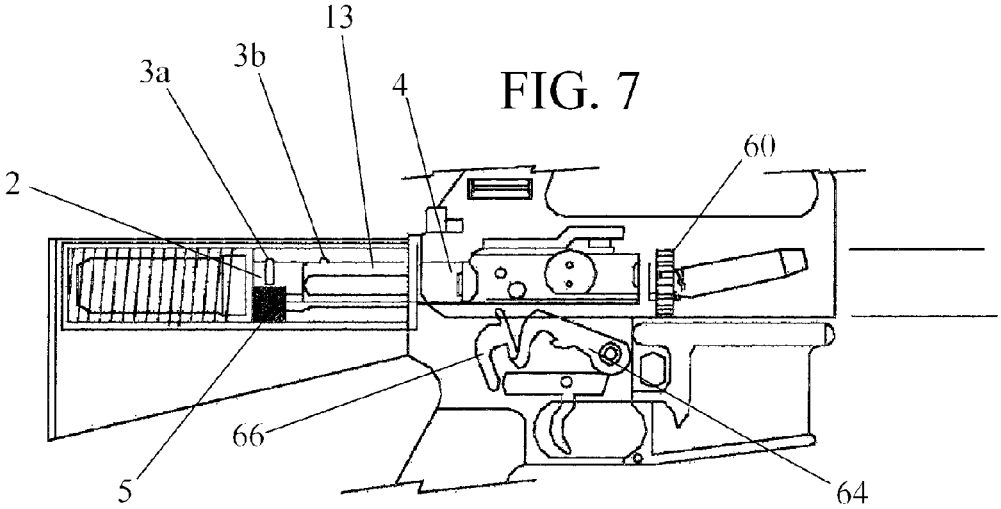
FIG. 7 is the rifle of FIG. 6 after firing.

In practice, the system replaces the standard bolt carrier of an AR-15 or other similar rifle, as seen in FIGS. 6 and 7. Prongs 13 being positioned forward, toward the bolt 60, which is inserted within bolt carrier 4. Prongs 13 define a central passage 62 within the bolt carrier 60 at the juncture with the remainder of the bolt carrier. This passage 62 coexists with channel 14 when the disconnector body is in the forward position and allows hammer 64 to pass through when firing. Hammer 64 is held in a downward position by sear 66 until sear 66 is disconnected.

During firing, bolt 60 and bolt carrier 4 are thrust backwards as is disconnector body 2. Being independent of carrier 4, disconnector body 2 continues backwards until ball bearing 12 interfaces detent 3*a*. On return, bolt 60 and carrier 4 are thrust forwards, along with disconnector body 2 in the rear position. When they stop, disconnector body 2 continues forward until ball bearing 12 interfaces with detent 3*b*. When the body reaches the forward position, striker body 5 disconnects the sear 66 and resets the weapon. Cylindrical channel 14 is positioned to allow the firing pin to actuate unhindered when ready to fire. The additional passage of the independently sliding disconnector body 2 delays firing as additional time for passage is required. The resultant delay will vary for the type of weapon and ammunition used, but typical delay reduces firing rate approximately one-third the normal firing rate.

Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. A firing rate reduction system for an automatic firearm comprising:

a modified bolt carrier further comprising:

a generally tubular carrier body, having a first arcuate section of tube wall partially incomplete and a second diametrically opposed section of tube wall partially incomplete and extending towards a rear of the bolt carrier, thereby creating a channel;

a generally cylindrical, slideable disconnector body, further comprising:

two diametrically opposed prongs;

a central base, providing a base for said prongs; and a platform, on a side of the base opposite the two prongs; and a striker, attachable on the platform of the disconnector body;

wherein the disconnector body is slideable within the bolt carrier and the striker is slideable within the channel of the bolt carrier.

2. A rate reduction system for a bolt operated firearm, said firearm comprising a hammer, firing pin, and sear, said system comprising:

A generally tubular bolt carrier having both an inner and an outer circumference and a defining axis, said carrier further comprising:

means for receiving a bolt at a first end of the bolt carrier;

means of passage by a hammer through said bolt carrier in a manner perpendicular to the defining axis; and a longitudinal channel at a second end, opposite the first end; and a sear disconnector, further comprising:

a cylindrical disconnector body, of a diameter sufficient to slide within the inner circumference of the bolt carrier;

a second means of passage by the hammer through the disconnector body, located on a first end of the disconnector body a strike plate, cantileverally situated on a second end of the disconnector body;

wherein, the bolt and disconnector body are inserted within the bolt carrier, the strike plate being nested in the longitudinal channel.

3. The system of claim 2, the bolt carrier further comprising at least one detent on the inner circumference, opposite the channel means and the disconnector body further comprises a stop means opposite the strike plate.

4. The system of claim 3, the stop means being a spring loaded ball bearing inserted on an exterior surface of the disconnector body opposite the strike plate.

5. The system of claim 2, the second passage means being two prongs extending from the disconnector body towards the bolt and having sufficient length to allow the hammer to pass through the bolt carrier and disconnector when fully forward in relation to the bolt carrier.

* * * * *